US009915253B2

(12) United States Patent
Chou

(10) Patent No.: US 9,915,253 B2
(45) Date of Patent: Mar. 13, 2018

(54) AIR COMPRESSOR

(71) Applicant: Wen-San Chou, Tainan (TW)

(72) Inventor: Wen-San Chou, Tainan (TW)

( * ) Notice: Subject to any disclaimer, the term of this patent is extended or adjusted under 35 U.S.C. 154(b) by 277 days.

(21) Appl. No.: 14/866,349

(22) Filed: Sep. 25, 2015

(65) Prior Publication Data

US 2016/0097379 A1 Apr. 7, 2016

(30) Foreign Application Priority Data

Oct. 1, 2014 (TW) ..... 103134243 A

(51) Int. Cl.

| | |
|---|---|
| ***F04B 35/01*** | (2006.01) |
| ***F04B 35/04*** | (2006.01) |
| ***F04B 39/12*** | (2006.01) |
| ***F04B 39/14*** | (2006.01) |
| ***F04B 41/02*** | (2006.01) |
| ***F04B 39/10*** | (2006.01) |

(52) U.S. Cl.

CPC ..... *F04B 35/01* (2013.01); *F04B 35/04* (2013.01); *F04B 39/10* (2013.01); *F04B 39/121* (2013.01); *F04B 39/122* (2013.01); *F04B 39/123* (2013.01); *F04B 39/125* (2013.01); *F04B 39/14* (2013.01); *F04B 41/02* (2013.01); *Y10T 137/7793* (2015.04)

(58) Field of Classification Search

CPC .. Y10T 137/7878; Y10T 137/7793–137/7831; F04B 35/04; F04B 39/10; F04B 39/14; F04B 39/121–39/125; F04B 49/22; F04B 49/225

See application file for complete search history.

(56) References Cited

U.S. PATENT DOCUMENTS

| | | | | | |
|---|---|---|---|---|---|
| 1,470,548 | A * | 10/1923 | Spohrer | F04B 39/00 | 417/415 |
| 2,160,401 | A * | 5/1939 | Engelman | F04B 39/1073 | 137/454.6 |
| 2,431,769 | A * | 12/1947 | Parker | F16K 15/026 | 137/469 |
| 3,664,371 | A * | 5/1972 | Schneider | F16K 15/028 | 137/516.29 |
| 2010/0147416 | A1* | 6/2010 | Chou | F04B 35/008 | 141/38 |

(Continued)

*Primary Examiner* — Charles Freay
*Assistant Examiner* — Thomas Fink

(57) ABSTRACT

An improved air compressor includes a cylinder fitted with a piston body and an air storage container. The cylinder and the air storage container are detachably assembled to define an air chamber. A metal seat with a through hole is provided on top of the cylinder. A valve plug is spring-biased against the metal seat. The air storage container is provided with an elongated pressure indicator, which includes a transparent tube defining therein a first bore and a second bore, between which a tapered annular surface is formed. When the air pressure within the air storage container exceeds a predetermined pressure set for the air compressor, the elongated pressure indicator allows excess air to flow into the first bore of the transparent tube and pass through the tapered annular surface to be released to the ambient environment, so that objects can be prevented from damages due to excessive inflations.

6 Claims, 10 Drawing Sheets

(56) References Cited

U.S. PATENT DOCUMENTS

| | | | | |
|---|---|---|---|---|
| 2013/0011283 | A1* | 1/2013 | Chou | F04B 35/04<br>417/437 |
| 2014/0134025 | A1* | 5/2014 | Chou | F04B 39/122<br>417/540 |
| 2014/0216164 | A1* | 8/2014 | Chou | G01L 7/166<br>73/732 |

* cited by examiner

AIR COMPRESSOR

TECHNICAL FIELD OF THE INVENTION

The present invention relates to an air compressor and, more particularly, to an improved air compressor, wherein an air storage container and a cylinder thereof can be detachably assembled to define an air chamber, an air passage design between the air storage container and the cylinder is provided for reducing the motion resistance of a piston body within the cylinder so that the piston body can conduct reciprocating motion more smoothly, a metal seat is integrally embedded as a top element of the air passage design between the air storage container and the cylinder to ensure the sealing function of a valve plug thereof, and an elongated pressure indicator is provided for an outlet of the air storage container for indicating the pressure of compressed air within the air storage container and releasing excess compressed air into the ambient environment without additional pressure relief valves, so that objects will not be excessively inflated to cause damages.

DESCRIPTION OF THE PRIOR ART

Conventionally, air compressors, especially the small air compressors being used for inflating objects such as tires and air cushions, employ an air storage container formed integrally on a cylinder to produce compressed air, wherein an air port is provided between the air storage container and the cylinder, and a valve plug is urged by a spring to normally seal the air port, one end of the spring being engaged with the valve plug, and the other end of the spring being attached by bolts to a top cap that is used to close a top opening of the air storage container. The disadvantage is that the valve plug and the spring are difficult to be assembled into the air storage container.

Generally, conventional air compressors are provided with two outlets or ducts, one of which is installed with a circular pressure gauge and the other of which is connected with a hose that is provided with an air nozzle for inflating an object such as a tire. The circular pressure gauge can show the pressure of the compressed air within the air storage container for users. Since the circular pressure gauge, which employs a Bourdon tube as a pressure sensor, contains precision components, when it falls to the ground or experiences a large impact, the pressure gauge is prone to be damaged and thus loses its accuracy.

In view of the foregoing, there is a need to provide an improved air compressor, wherein an air storage container and a cylinder thereof can be detachably assembled to define an air chamber, an air passage design between the air storage container and the cylinder is provided for reducing the motion resistance of a piston body so that the piston body can conduct reciprocating motion more smoothly, and a robust pressure indicator is provided for indicating the air pressure within the air storage container and releasing excess air into the ambient environment, without installing additional pressure relief valves, when the air pressure exceeds a predetermined pressure set for the air compressor.

SUMMARY OF THE INVENTION

One object of the present invention is to provide an improved air compressor, wherein an air storage container and a cylinder thereof can be detachably assembled to define an air chamber, and an air passage design between the air storage container and the cylinder is provided for reducing the motion resistance of a piston body within the cylinder so that the piston body can conduct reciprocating motion more smoothly.

Another object of the present invention is to provide an improved air compressor, wherein a metal seat is integrally embedded as a top element of the air passage design between the air storage container and the cylinder to ensure the sealing function of a valve plug thereof.

A further object of the present invention is to provide an improved air compressor, wherein an elongated pressure indicator is provided for an outlet thereof for indicating the pressure of compressed air within the air storage container and releasing excess compressed air into the ambient environment without additional pressure relief valves, so that objects will not be excessively inflated to cause damages.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
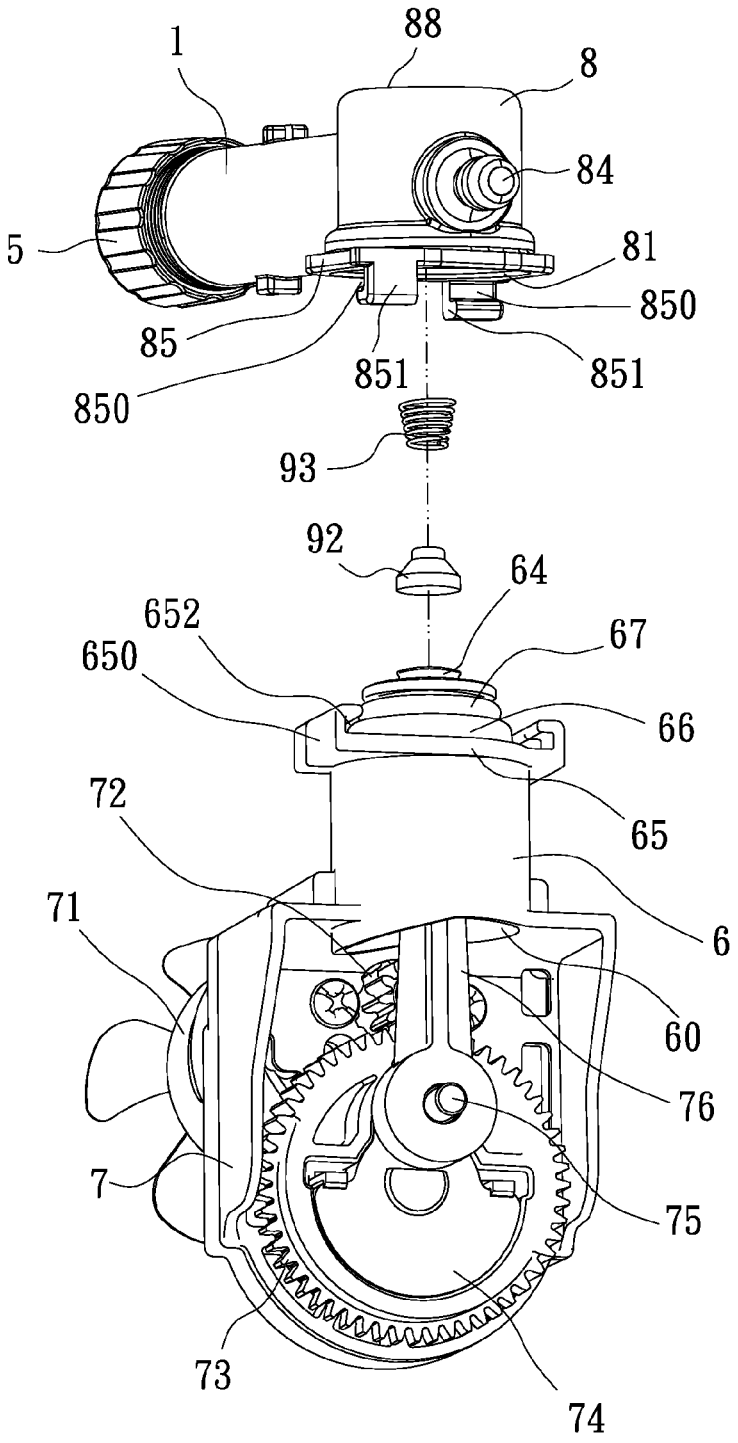
FIG. 1 shows an exploded view of an air compressor according to one embodiment of the present invention, wherein the air storage container is disassembled from the cylinder.

Referring to FIGS. 1 through 7, an improved air compressor according to one embodiment of the present invention is shown, wherein a motor 71 is mounted to a main frame 7, and a small gear 72 is fitted to an output axle of the motor 71. Furthermore, a large gear 73 is mounted to the main frame 7 to be engaged with the small gear 72. A cylinder 6 is provided at the main frame 7. A piston body 76, which conducts reciprocating motion within the cylinder 6, is pivotally connected to a crank pin 75 that is fixed to a counterweight 74 being attached to the large gear 73. The motor 71 can drive the small gear 72 to rotate the large gear 73, which swings the crankpin 75 to cause the piston body 76 to conduct reciprocation motion within the cylinder 6 for producing compressed air.

Figure 7:
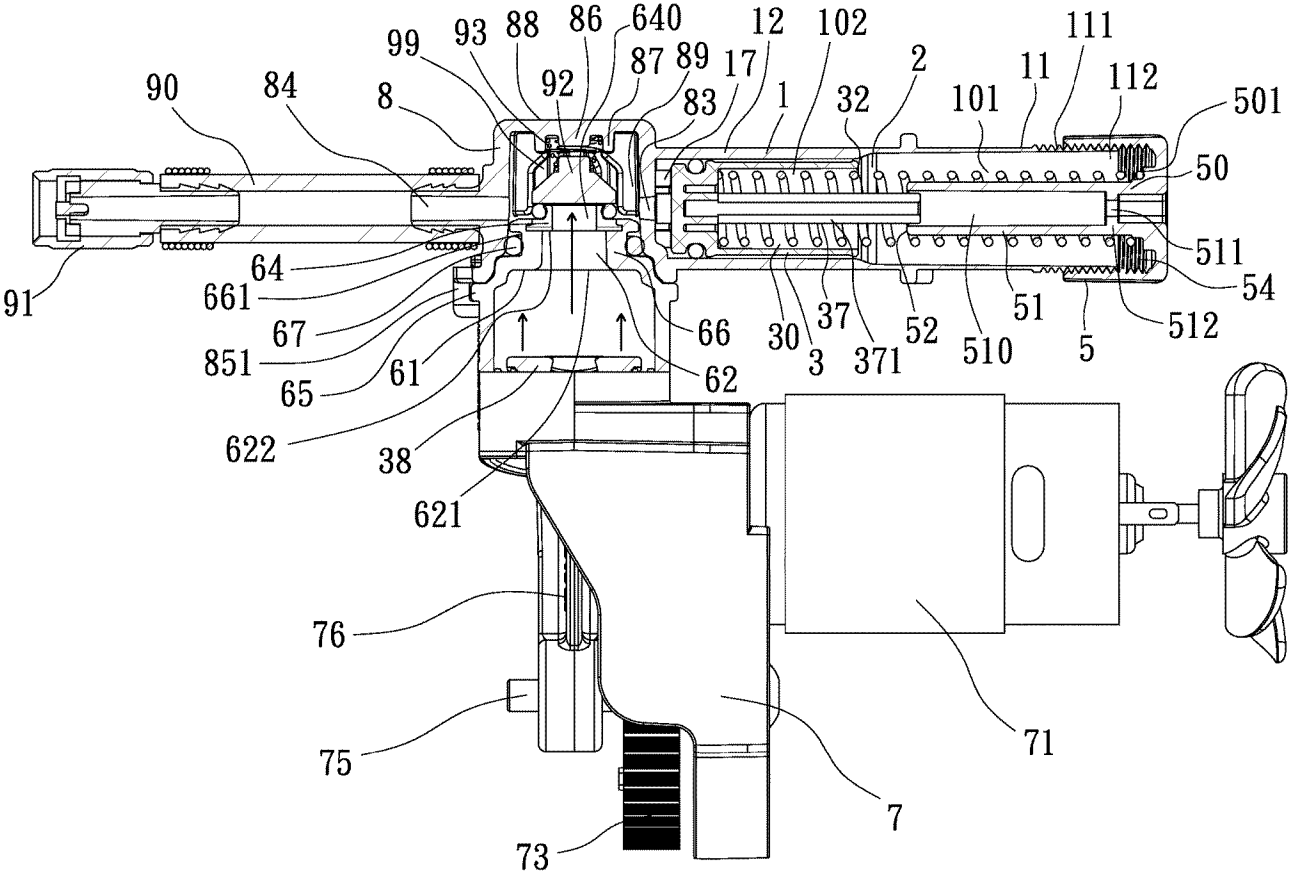
FIG. 7 shows a partially sectional view of the air storage container with the elongated pressure indicator, wherein the slider of the elongated pressure indicator is at its original position (the air compressor is stopped).

The cylinder 6 has an open bottom 60, through which the piston body 76 can be fitted into the cylinder 6, and a top wall 61, on which a tubular projection 66 is formed (see FIG. 7). The tubular projection 66 defines therein a first through hole 62 including a first end 621 and a second end 622, wherein the first through hole 62 communicates with the cylinder 6 at its first end 621. A metal seat 64, which defines a second through hole 640, is provided on the tubular projection 66. Specifically, the metal seat 64 is integrally embedded in the tubular projection 66, wherein the first through hole 62 communicates with the second through hole 640 at its second end 622. The first through hole 62 of the tubular projection 66 and the second through hole 640 of the metal seat 64 constitute an air passage that communicates the air storage container 8 with the cylinder 6. The tubular projection 66 defines an annular groove 661 at its outer surface to be fitted with a seal ring 67. The cylinder 6 is provided with a first flange 65 at its surrounding wall, near its top wall 61. The first flange 65 is provided with two opposite U-shaped holding portions 650, each of which defines a first recess 652.

A cylindrical air storage container 8 has an open bottom 81 and a closed top 88 and defines therein an inner space 82 terminating at the open bottom 81. A plurality of spaced-apart ribs 89 is provided at an inner surface of the air storage container 8. The air storage container 8 is provided at its open bottom 81 with a second flange 85 of appropriate thickness, which is provided with two opposite U-shaped holding portions 851, each of which defines a second recess 850. A central column 86 is provided at an inner surface of the closed top 88 of the air storage container 8 and extends downwardly at a predetermined distance. An annular protrusion 87 is provided at the inner surface of the closed top 88 of the air storage container 8, around the central column 86, thus defining an annular groove 80 therebetween.

A valve plug 92, usually made of plastic, is placed on the metal seat 64 for sealing the second through hole 640 thereof. In operation, the valve plug 92 may be moved at a high frequency, which tends to increase the temperature of the metal seat 64. Since the metal seat 64 can undergo deformation due to high temperature, so that the sealing function of the valve plug 92 will not be affected. The air storage container 8 can be fitted over the cylinder 6 and rotated about the cylinder 6 to allow the second flange 85 of the air storage container 8 to slide in the first recesses 652 of the cylinder 6 and allow the first flange 65 of the cylinder 6 to slide in the second recess 850 of the air storage container 8, so that the air storage container 8 is detachably mounted to the cylinder 6, thereby sealing the cylinder 6 and defining an air chamber 99 therebetween (see FIGS. 1, 2 and 7). This design facilitates a user to assemble the compression spring 93 and the valve plug 92 into the air storage container 8. After mounting the air storage container 8 onto the cylinder 6, one end of the compression spring 93 is urged against the valve plug 92 while the other end of the compression spring 93 is fitted around the central column 86 and received in the annular groove 80. The central column 86 can limit the upward movement of the valve plug 92. The length of the central column 86 can affect the speed of the valve plug 92 sealing the second through hole 640 of the metal seat 64. A longer column will limit the movement of the valve plug 92 more than a shorter column. Thus, if the central column 86 is long, the valve plug 92 will seal the second through hole 640 quickly. On the other hand, if the central column 86 is short, the valve plug 92 will seal the second through hole 640 slowly. The air chamber 99 defined between the air storage container 8 and the metal seat 64 can receive the compressed air from the cylinder 6. In this embodiment, at least two outlets 83, 84 are provided at the air storage container 8, wherein the outlet 83 is joined with an elongated pressure indicator, and the outlet 84 is connected with a hose 90 including an air nozzle 91.

Figure 5:
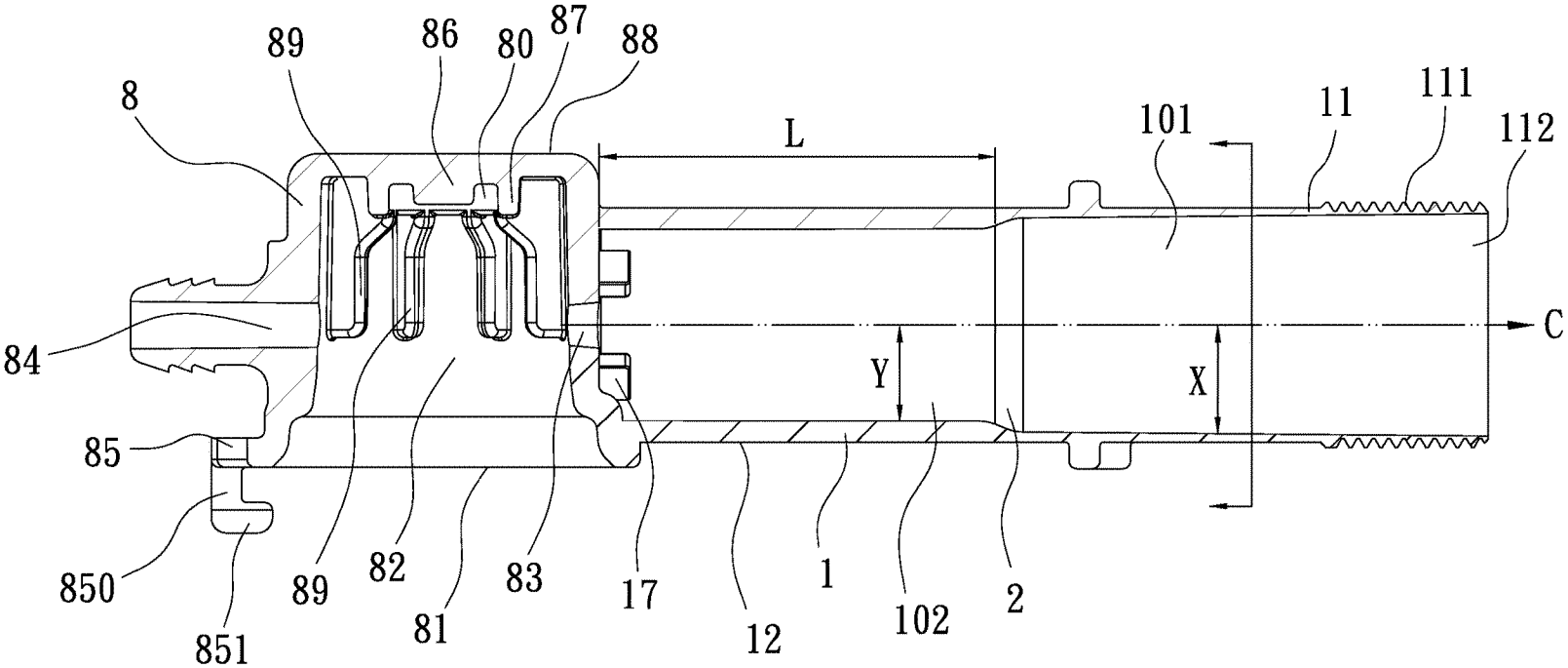
FIG. 5 shows a sectional view of the air storage container with the transparent tube of the elongated pressure indicator.
Figure 6:
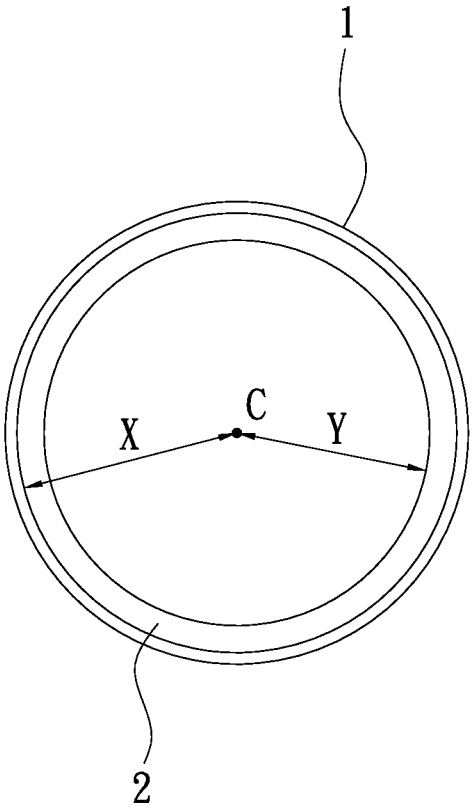
FIG. 6 shows a schematic plan view of the transparent tube, which is viewed from its open end.

The elongated pressure indicator generally includes a transparent tube 1, a slider 3, a coiled compression spring 4, and a cap 5, wherein the transparent tube 1 has a first segment 11 and a second segment 12. The second segment 12 is joined to the outlet 83 and defines therein a second bore 102. The first segment 11, which is formed integrally with the second segment 12, has an open end 112 provided with external threads 111 and defines therein a first bore 101 that communicates with the second bore 102 and terminates at its open end 112. As shown in FIGS. 5 and 6, the radius of the first bore 101 of the first segment 11 is indicated by X, which is the distance between the central axis C and the inner surface of the first segment 11; the radius of the second bore 102 of the second segment 12 is indicated by Y, which is the distance between the central axis C and the inner surface of the second segment 12, wherein X is greater than Y. As shown, a tapered annular surface 2 is formed between the inner surface of the first segment 11, which defines the first bore 101, and the inner surface of the second segment 12, which defines the second bore 102. The tapered annular surface 2 is provided for connecting two tube segments of different diameters. Although this embodiment provides the tapered annular surface 2, which extends outwardly with the central axis of the transparent tube 1 in a linear path, a curved annular surface, which extends outwardly with the axis of the transparent tube 1 in a curved path, can be used as well. A plurality of buffering blocks 17 is provided at the surrounding wall of the air storage container 8, around the outlet 83. A pressure-indicating scale 18 is provided at the outer surface of the second segment 12 of the transparent tube 1.

The slider 3, which is a generally hollow cylindrical body, has a closed end 31 and an open end 32 and defines therein an inner space 30 terminating at the open end 32. The slider 3 is provided with a first central tube 37 that extends from an inner surface of its closed end 31 and extends through the inner space 30. The first central tube 37 of the slider 3 defines at its surrounding wall a plurality of slits 371 extending along its lengthwise direction. The slider 3 defines an annular groove 33 at its outer wall, near its closed end 31. A colored O-ring 34 is fitted into the annular groove 33 of the slider 3. The displacement of the slider 3 is generally proportional to the pressure of the compressed air within the air storage container 8. Thus, the total length (L) of the second bore 102 of the second segment 12 depends on the maximum pressure of the compressed air within the air storage container 8 to be measured (see FIG. 5). When the elongated pressure indicator is designed for receiving compressed air of higher pressure, the total length (L) of the second bore 102 can be increased. On the other hand, when the elongated pressure indicator is designed for receiving compressed air of lower pressure, the total length (L) of the second bore 102 can be decreased.

Figure 4:
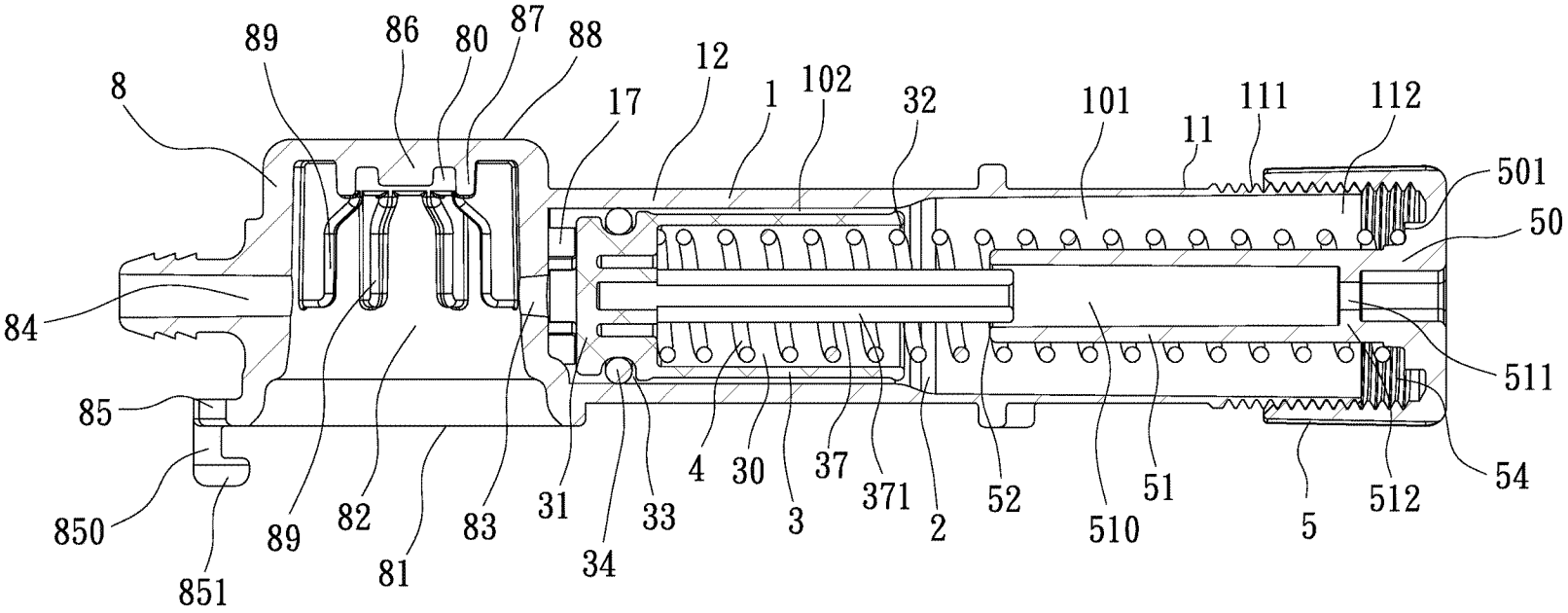
FIG. 4 shows a sectional view of the air storage container with the elongated pressure indicator.

As shown in FIG. 4, the coiled compression spring 4 is fitted into the inner space 30 of the slider 3, around the first central tube 37, wherein one end of the coiled compression spring 4 is urged against the inner surface of the closed end 31 of the slider 3. The coiled compression spring 4 of the elongated pressure indicator may slightly contact the inner surface of the slider 3, which defines the inner space 30. The slider 3 is inserted in the transparent tube 1 and forced by the coiled compression spring 4, so that the slider 3 is urged against the buffering blocks 17 provided on the air storage container 8. The outlet 83 communicates with the second bore 102 of the second segment 12 of the transparent tube 1, so that the compressed air within the air storage chamber 8 can flow into the second bore 102 to force the slider 3 to move along the second bore 102 and the first bore 101 towards the open end 112, as shown in FIGS. 7 through 10.

Figure 2:
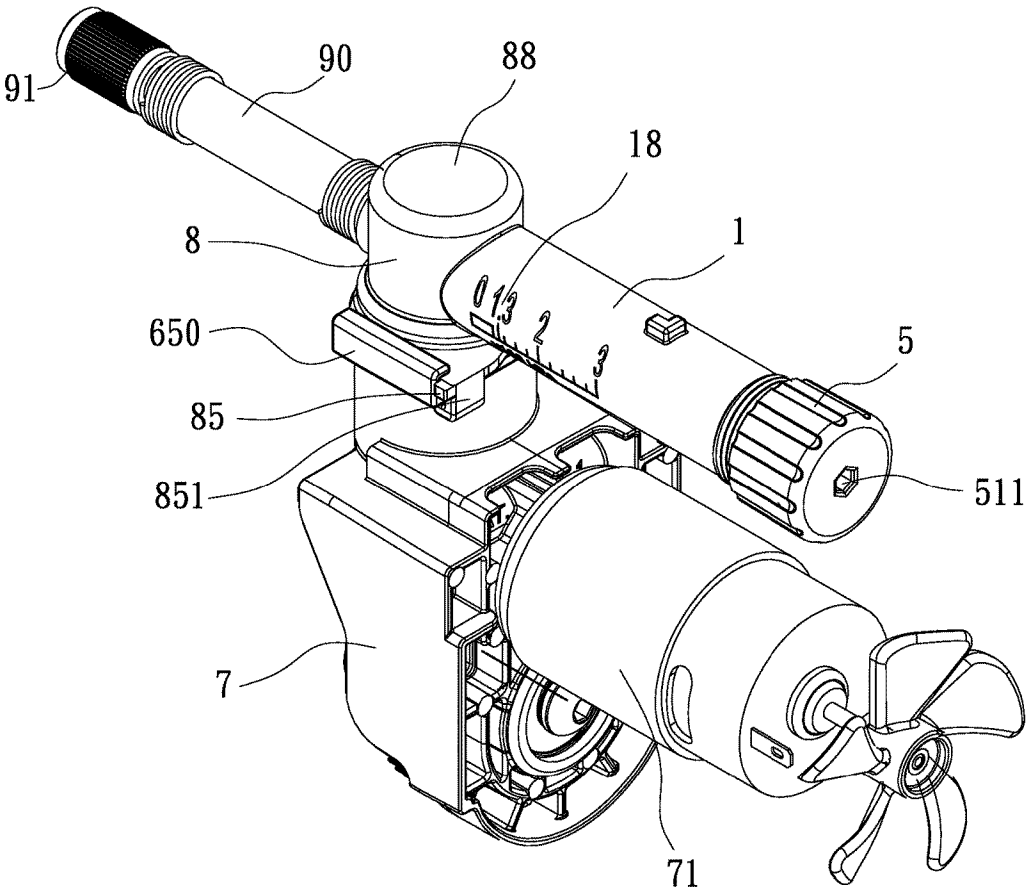
FIG. 2 shows a 3-dimensional view of the air compressor of the embodiment of the present invention, wherein the air storage container is assembled to the cylinder.
Figure 3:
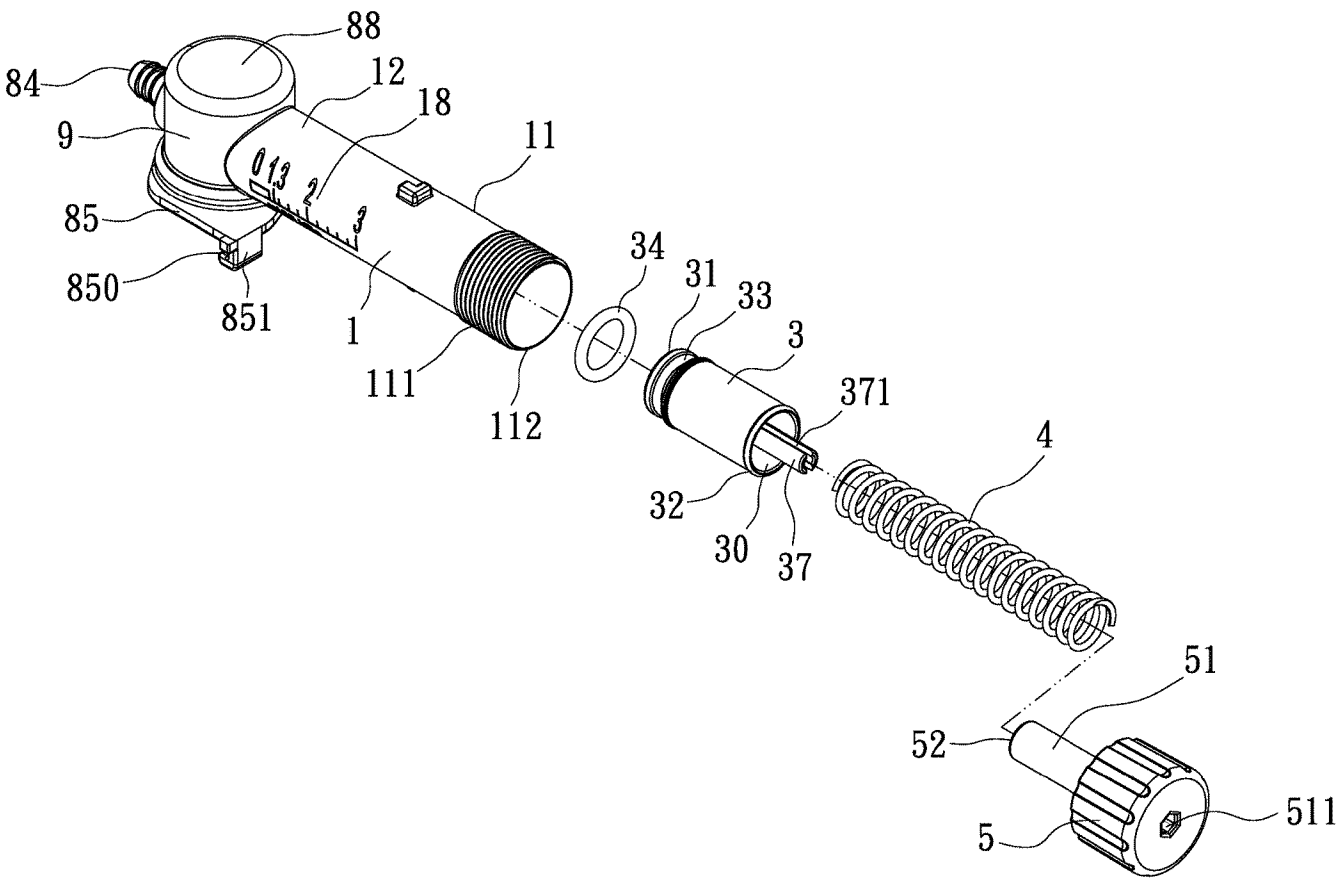
FIG. 3 shows an exploded view of an elongated pressure indicator used in the present invention.

As shown in FIGS. 3 and 4, the cap 5 has an inner base 50 and a second central tube 51 extending from the inner base 50. The cap 5 is provided at its inner surface with internal threads 54, corresponding to the external threads 111 provided on the open end 112 of the first segment 11 of the transparent tube 1, for being threadedly mounted to the open end 112 of the first segment 11. The second central tube 51 has a diameter less than the inner base 50 such that an annular surface 501 is formed between the inner base 50 and the second central tube 51. The second central tube 51 defines therein a central hole 510 that extends from a bottom wall 512 thereof to an open end 52 thereof. The bottom wall 512 defines a vent 511, through which the compressed air from the air storage container 8 can be released into the ambient environment. The diameter of the central hole 510 of the second central tube 51 of the cap 5 is greater than the external diameter of the first central tube 37 of the slider 3. The external diameter of the second central tube 51 of the cap 5 is less than the internal diameter of the coiled compression spring 4. The other end of the coiled compression spring 4 is urged against the annular surface 501 between the inner base 50 and the second central tube 51. Turning the cap 5 over the open end 112 of the transparent tube 1 allows the external threads 111 of the open end 112 of the first segment 11 to be engaged with the internal threads 54 of the cap 5, thereby fixing the cap 5 onto the transparent tube 1. The second central tube 51 of the cap 5 can receive the first central tube 37 of the slider 3, wherein the external diameter of the first central tube 37 is slightly less than the diameter of the central hole 510 of the second central tube 51. The depth of the cap 5 being threaded over the first segment 11 of the transparent tube 1 can adjust the compression of the coiled compression spring 4, so that the pressure of the compressed air can be measured more properly. FIG. 2 shows the elongated pressure indicator of the present invention, which is obtained by assembling the transparent tube 1, the slider 3, the colored seal ring 34, the coiled compression spring 4, and the cap 5.

Figure 8:
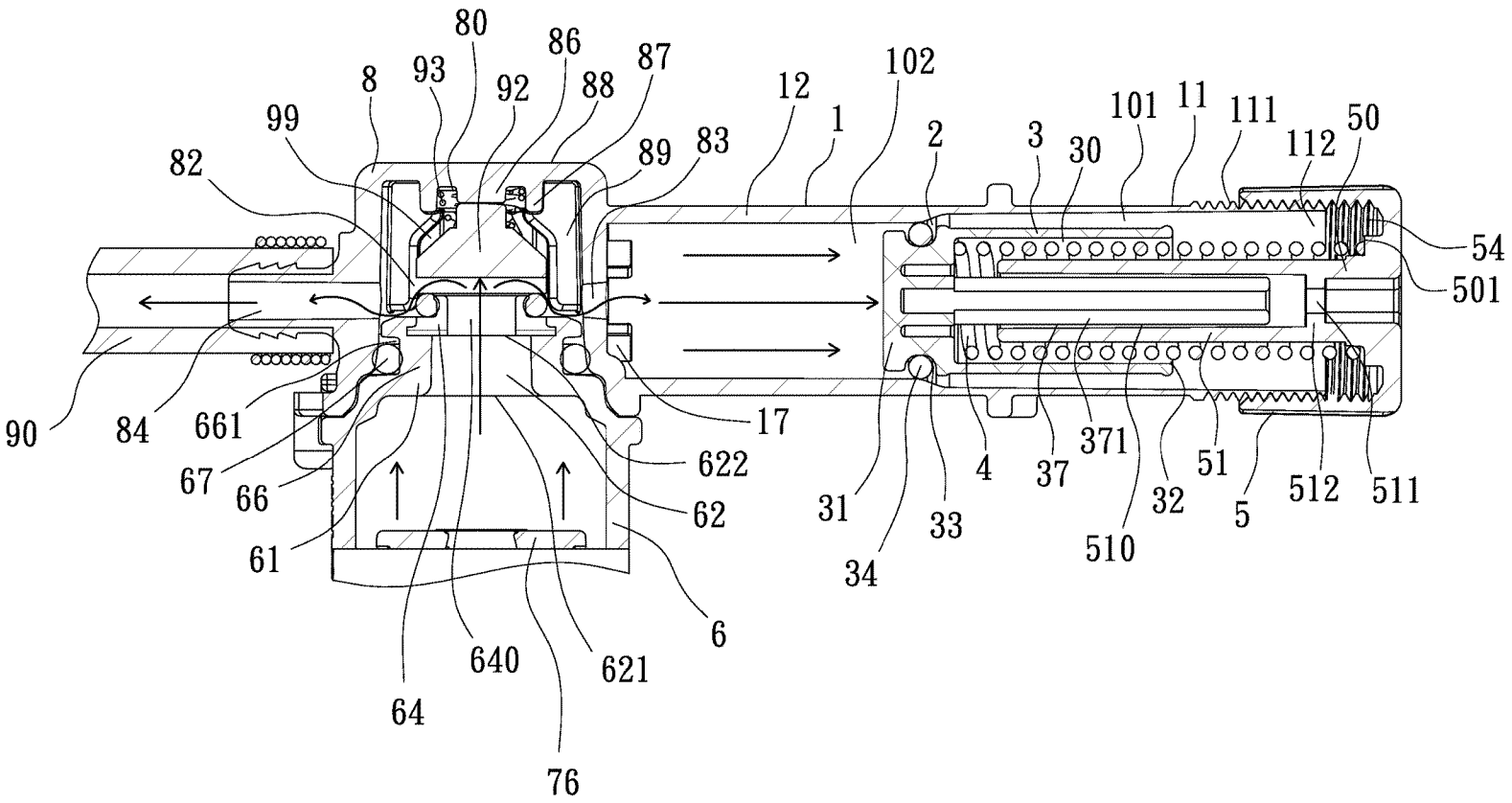
FIG. 8 shows a sectional working view of the elongated pressure indicator used in the present invention, wherein the slider is forced by the compressed air from the air storage container to move towards the open end of the transparent tube.
Figure 9:
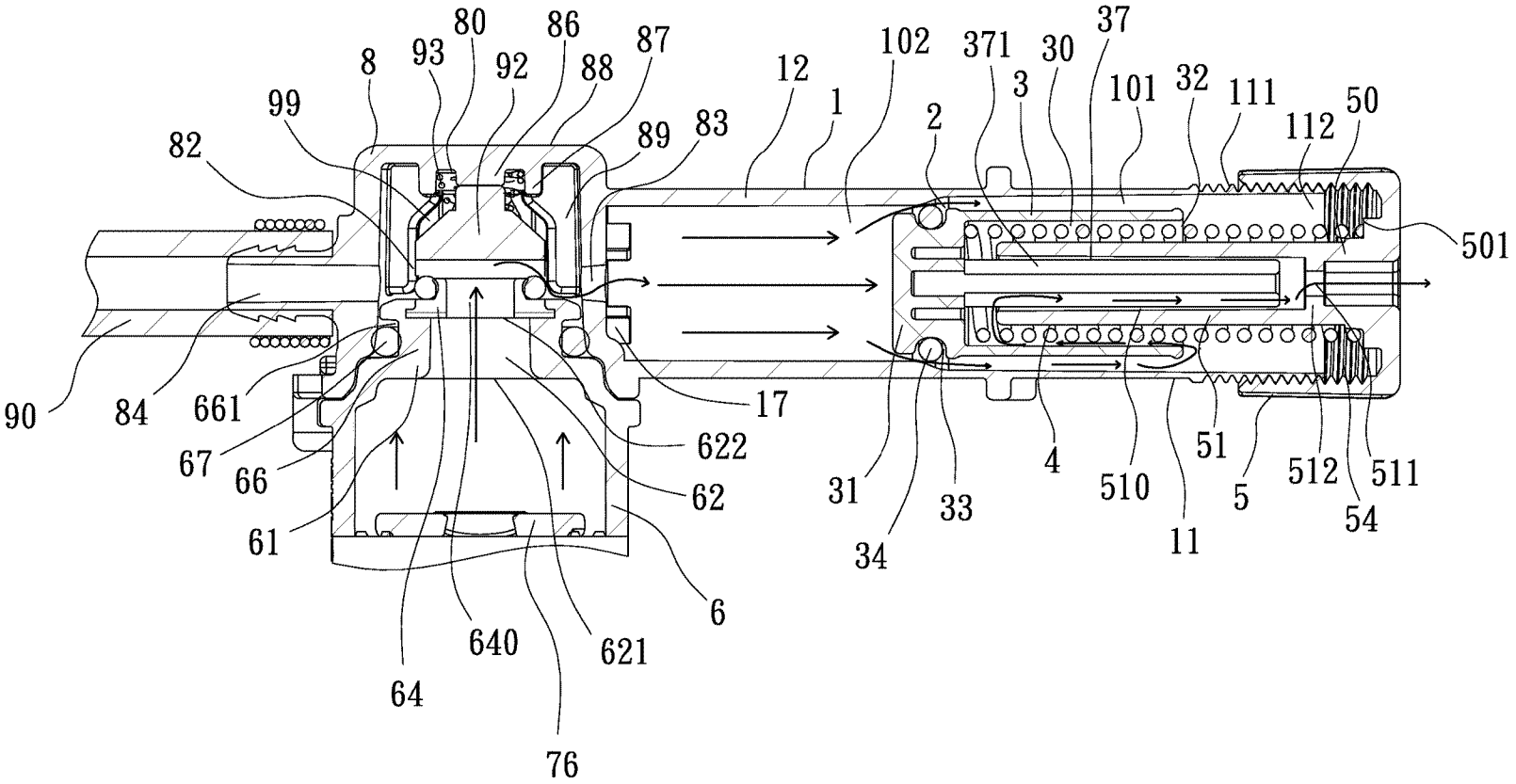
FIG. 9 shows a sectional working view of the elongated pressure indicator used in the present invention, wherein the slider is forced by the compressed air from the air storage container to reach the tapered annular surface of the transparent tube, when excess compressed air can be released into the ambient environment.
Figure 10:
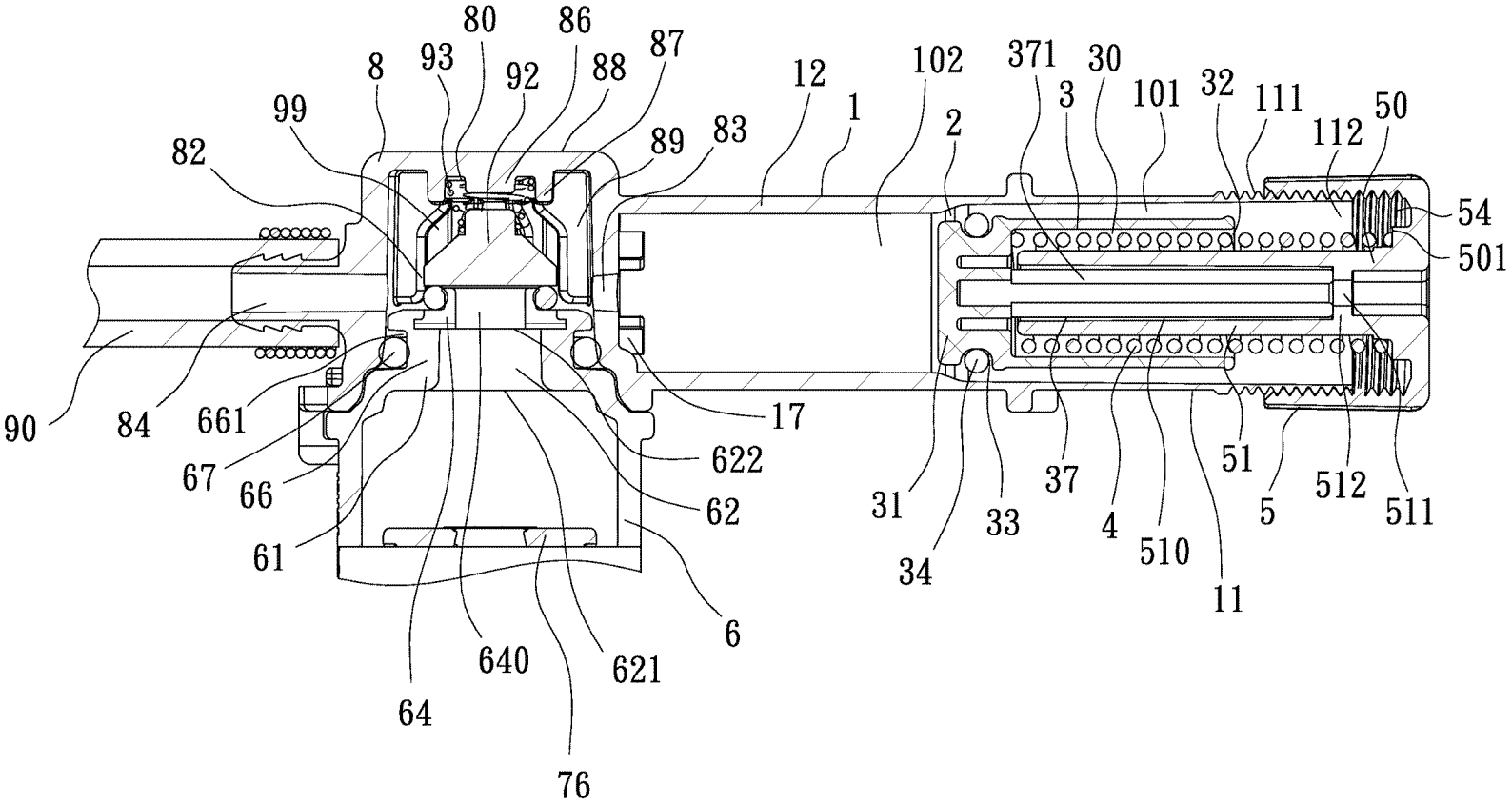
FIG. 10 shows a sectional working view of the elongated pressure indicator used in the present invention, wherein the slider is forced by the compressed air from the air storage container to reach its final position.

In operation, as shown in FIGS. 2 and 7, the compressed air within the air storage container 8 can flow into the transparent tube 1 via the outlet 83 to force the slider 3 to move towards the open end 112. The movement of the slider 3 will compress the coiled compression spring 4. According to the pressure-indicating scale 18, the position of the colored seal ring 34 provided on the slider 3, which reflects the pressure of the compressed air within the air storage container 8, can be clearly seen through by a user, as shown in FIGS. 8 and 9. After having completed inflating an object such as a tire, the air compressor can be stopped. Thus, the restoring force of the coiled compression spring 4 can force the slider 3 to return to its previous position, as shown in FIG. 7. When the pressure of the compressed air within the air storage container 8 exceeds the permissible pressure set for the air compressor, the closed end 31 of the slider 3 will approach the tapered annular surface 2 of the transparent tube 1, and thus an excess of compressed air can flow into the first bore 101 of the first segment 11 and then pass through the vent 511 to be released into the ambient environment. More specifically, when the colored O-ring 34 is moved together with the slider 3 to reach the tapered annular surface 2, there is a gap between the colored O-ring 34 and the tapered annular surface 2 (see FIG. 9), an excess of compressed air can flow into the first bore 101 of the first segment 11 via the gap, and then can sequentially pass through the inner space 30 of the slider 3, the slits 371 of the first central tube 37, and the central hole 510 of the second central tube 51, and finally flow out of the vent 511 to be released into the ambient environment. The bottom wall 512 can limit a further movement of the slider 3 to prevent the flow path of the compressed air from being blocked (see FIG. 10), thus ensuring an effective release of excess compressed air.

As a summary, one feature of the present invention is that the air storage container 8 can be detachably mounted to the cylinder 6 to define an air chamber 99. A second feature of the present invention is that the first through hole 62 of the tubular projection 66 can reduce the motion resistance of the piston body 76 within the cylinder 6, so that the piston body 76 can be moved more smoothly. A third feature of the present invention is that the metal seat 64 can undergo high frequency movement of the valve plug 92 without deformation, so that the sealing effect of the valve plug 92 can be ensured. A fourth feature of the present invention is that the air storage container 8 is provided at an outlet thereof with an elongated pressure indicator, which can reflect the pressure of the compressed air within the air storage container 8, and furthermore, which allows excess compressed air to be released into the ambient environment without installing additional safety valves or pressure relief valves, so that objects, such as tires, can be prevented from being overly inflated.

I claim:

1. In an air compressor that includes a main frame, a motor mounted to the main frame, and a cylinder fitted with a piston body and provided at the main frame, the motor capable of driving the piston body to conduct reciprocating motion within the cylinder for producing compressed air, wherein the improvement comprises: the cylinder has an open bottom, through which the piston body is fitted into the cylinder, and a top wall opposite to the open bottom, the top wall being not fully closed, wherein the cylinder is provided with a first flange at its surrounding wall, near its top wall, the first flange is provided with two opposite holding portions each defining a first recess; an air storage container has an open bottom and a closed top and defines therein an inner space terminating at the open bottom, the air storage container being provided at its open bottom with a second flange that is provided with two opposite holding portions each defining a second recess; whereby the air storage container is capable of being fitted over the cylinder and rotated about the cylinder to allow the second flange of the air storage container to slide in the first recesses of the cylinder and allow the first flange of the cylinder to slide in the second recess of the air storage container, so that the air storage container is detachably mounted to the cylinder, thereby sealing the cylinder and defining an air chamber therebetween, wherein the air storage container is provided with at least two outlets, one of which is connected with an elongated pressure indicator and another of which is connected with a hose provided with an air nozzle, wherein the elongated pressure indicator includes a transparent tube, a slider, a coiled compression spring, and a cap, wherein the transparent tube has a first segment and a second segment, the second segment being joined to one outlet of the air storage container and defining therein a second bore, the first segment being formed integrally with the second segment and having an open end and defining therein a first bore that communicates with the second bore and terminates at its open end, the first bore having a diameter greater than the second bore, a tapered annular surface formed between an inner surface of the first segment, which defines the first bore, and an inner surface of the second segment, which defines the second bore, a pressure-indicating scale being provided at an outer surface of the second segment; the slider is a generally hollow cylindrical body having a closed end and an open end and defining therein an inner space that terminates at the open end, the slider being provided with a first central tube that extends from an inner surface of its closed end and extends through its inner space; the coiled compression spring is fitted into the inner space of the slider, around the first central tube, one end of the coiled compression spring being urged against the inner surface of the closed end of the slider; the cap is provided with a second central tube and threadedly mounted to the open end of the first segment of the transparent tube; whereby the compressed air contained in the air storage container can flow into the inner space of the second segment via the outlet and thus force the slider to move along the second bore and the first bore towards the open end of the first segment of the transparent tube for measuring the pressure of the compressed air within the air storage container, and furthermore, when the closed end of the slider approaches the tapered annular surface of the transparent tube, the compressed air can be released into the ambient environment.

2. The air compressor of claim 1, wherein the first bore of the first segment has a radius of X, and the second bore of the second segment has a radius of Y, wherein X is greater than Y.

3. The air compressor of claim 1, wherein the first central tube of the slider defines a plurality of slits at its surrounding wall, along its lengthwise direction, the slider defines an annular groove at its surrounding wall, near its closed end, and a colored O-ring is fitted into the annular groove of the slider.

4. The air compressor of claim 1, wherein the coiled compression spring of the elongated pressure indicator slightly contacts the inner surface that defines the inner space of the slider.

5. The air compressor of claim 1, wherein the cap has an inner base, the second central tube extending from the inner base, the second central tube has a diameter less than the inner base such that an annular surface is formed between the inner base and the second central tube, the second central tube defining therein a central hole that extends from a bottom wall thereof to an open end (52) thereof, the bottom wall defining a vent, through which the compressed air from the air storage container can be released into the ambient environment, the diameter of the central hole of the second central tube being greater the external diameter of the first central tube of the slider, the external diameter of the second central tube of the cap being less than the internal diameter of the coiled compression spring, the other end of the coiled compression spring being urged against the annular surface between the inner base and the second central tube.

6. The air compressor of claim 1, wherein the first segment is provided at its open end with external threads while the cap is provided at its inner surface with internal threads corresponding to the external threads, whereby the compression of the coiled compression spring is adjusted by the depth of the cap being threadedly mounted to the open end of the first segment, so that the pressure of the compressed air can be measured more properly.

* * * * *